United States Patent [19]
Luenser
[11] 4,197,955
[45] Apr. 15, 1980

[54] TAMPER-PROOF CLOSURE

[75] Inventor: Werner R. Luenser, Blue Island, Ill.
[73] Assignee: Ethyl Products Company, Baton Rouge, La.

[21] Appl. No.: 954,975
[22] Filed: Oct. 26, 1978
[51] Int. Cl.[2] ..... B65D 41/34
[52] U.S. Cl. ..... 215/252; 215/232
[58] Field of Search ..... 215/252, 232; 220/266

[56] References Cited

U.S. PATENT DOCUMENTS

| | | | |
|---|---|---|---|
| 3,259,233 | 7/1966 | Beeman | 220/214 |
| 3,438,528 | 4/1969 | Fields | 215/252 |
| 3,455,478 | 7/1969 | Fields et al. | 215/252 |
| 3,874,540 | 4/1975 | Hidding | 215/252 |
| 3,920,503 | 11/1975 | Keeler | 215/252 X |

*Primary Examiner*—Donald F. Norton
*Attorney, Agent, or Firm*—Donald L. Johnson; John F. Sieberth; Edgar E. Spielman, Jr.

[57] ABSTRACT

A tamper-proof package having a container and closure is disclosed. The container has a threaded neck and an outwardly projecting flange beneath the container threads. The cap has a top wall and a downwardly depending sidewall with the sidewall having inwardly projecting, helical threads for cooperation with the container threads. Provided as part of the cap is an annular cap flange which is disposed beneath the cap sidewall and adapted for connection to the container flange. Holding the annular cap flange to the cap body is achieved by the utilization of a plurality of elongated connecting ribs. These connecting ribs extend downward from the cap sidewall to the cap flange and have a direction of slope opposite the direction of the helix angle of the cap helical thread.

14 Claims, 6 Drawing Figures

TAMPER-PROOF CLOSURE

BACKGROUND OF THE INVENTION

The utilization of tamper-proof caps on containers is well known in the art. A particularly ubiquitous tamper-proof package is one which has a container with a threaded neck and an outwardly extending flange beneath the neck threads. The cap screws onto the container threads and has a sealing ring which overlaps the container flange. The sealing ring is attached to the cap by a plurality of perpendicular webs or ribs which form a shear zone whih is fracturable. In operation, opening torque is applied to the cap causing the shearing of the webs or ribs as the cap moves away from the sealing ring which is held fast by the container flange. Once the cap is removed from the container, it is easy for the user to see that the sealing ring has been separated from the cap and that the container has had a previous opening.

While this type of package does give indication of tampering, it is not without serious drawbacks. In many instances the user of the package will be an enfeebled person suffering from arthritis or other ailments and will not be able to apply sufficient torque to both shear the webs or ribs and to overcome the resistance to opening of the tightened cap. The only recourse in this situation is for the user to cut the webs or ribs with a sharp instrument such as a knife. After the webs or ribs have been sheared, then even the enfeebled person is able to loosen the tightened cap. It is the combination of torque required to shear the webs or ribs and to overcome the resistance of opening a tightened cap which has been found to produce this undesirable difficulty.

It is therefore an object of this invention to provide a tamper-proof cap which utilizes easily viewable, fracturable webs or ribs to indicate tampering but which, at the same time, does not require the user to shear these webs or ribs until after initial loosening of the tightened cap.

THE INVENTION

This invention relates to a tamper-proof package comprising: a container having a threaded neck and an outwardly projecting flange beneath the container threads; and a cap which features (i) a top wall, (ii) a downwardly extending annular sidewall, the sidewall having an inwardly helical thread for cooperation with the container threads, and (iii) an annular cap flange disposed beneath the cap sidewall and adapted for connection to the container flange. The flange is connected to the cap sidewall by way of a plurality of elongated connecting ribs. The ribs extend downward from the cap sidewall to the cap flange and have a direction of slope which is opposite the direction of the helical angle of the cap helical threads. By having the elongated connecting ribs slope downward, in a direction opposite the direction of the helical angle of the cap helical threads, it is possible to loosen the cap from its tightened position prior to having to fracture the tamper-indicating connecting ribs. The user therefore need not apply, at any time during removal of the cap from the container, a torque greater than that required to loosen the cap or fracture the connecting ribs. In distinction, conventional tamper-proof closures require application of sufficient torque to accomplish both purposes at the same time.

These and other features of this invention contributing satisfaction in use and economy in manufacture will be more fully understood from the following description of a preferred embodiment of the invention when taken in connection with the accompanying drawings wherein identical numerals refer to identical parts and in which.

Figure 1:
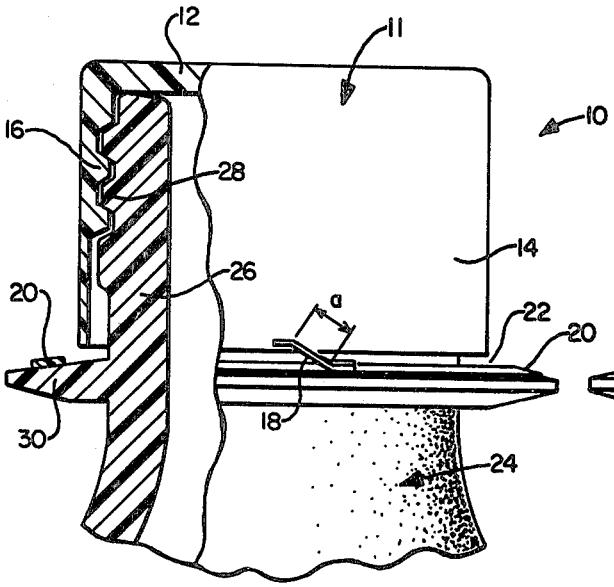
FIG. 1 is a partial, broken, elevational view of a package of this invention with the closure in the closed position.

Referring now to FIGS. 1–6, it can be seen that a tamper-proof package of this invention, generally designated by the numeral 10, has a thermoplastic tamper-proof cap, generally designated by the numeral 11, which fits onto a container, generally designated by the numeral 24. Container 24 is also of a thermoplastic material, it being preferred that cap 11 and container 24 be of similar material or be of materials which are compatible one with the other for achieving attachment between the annular cap flange and the bottle flange. When the materials of construction are similar, attachment has been found to be easily and economically achieved by sonic welding. When other methods of obtaining attachment, e.g. gluing, are utilized, the materials which make up the package will have to be compatible for that mode of attachment. It has been found that polyethylene terephthalate is a preferred material for use in the manufacture of cap 11 and container 24 as this material lends itself highly to sonic welding and also are highly suitable for the beverage industry in which industry the tamper-proof package of this invention would be highly suitable. However, other materials may be utilized as the need requires, with materials such as polyethylene, polyvinyl chloride and polypropylene being suitable and advisably used in those instances where these materials suit the particular needs of the packager.

Cap 11 has a top wall 12 and an integrally formed, downwardly depending sidewall 14. On the inside surface of sidewall 14 there is provided a helical inwardly directed thread 16 which cooperates with the helical, outwardly projecting thread 28 found on neck 26 of container 24. In most instances threads 16 and 28 will be right-hand threads. By right-hand threads it is understood that the threads have a helical angle which slopes from left to right in an upward direction when viewed in elevation and which requires that cap 11 be loosened from container 24 by application of a counter-clockwise torgue. A clockwise torque will, of course, tighten cap 11 to container 24. It is to be understood, however, that the package of this invention is not limited to right-hand threads as left-hand threads, i.e. those threads in which the helix angle results in the thread sloping downward from left to right, may also be utilized. The left hand thread requires oppositely directed torque from the right-hand thread to effect loosening and tightening of cap 11 to container 24.

Figure 2:
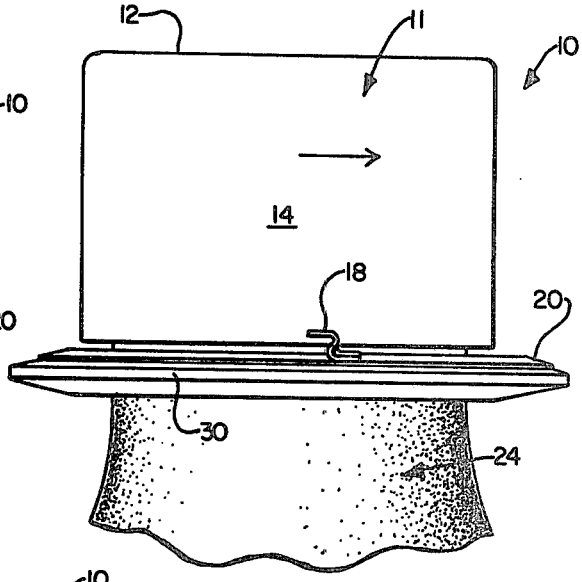
FIG. 2 is a side elevational view of the package shown in FIG. 1 with the closure in the process of being unscrewed from the container.

Beneath sidewall 14 there is annular cap flange 20. Annular cap flange 20 is integrally connected to cap sidewall 14 by means of a plurality of frangible connecting ribs 18. Space 22 is therefore present between cap sidewall 14 and cap flange 20. Note in FIGS. 1, 4 and 5 that ribs 18 are elongated and that they are connected so that they extend downward from cap sidewall 14 to annular cap flange 20 to give a direction of slope which is opposite the direction of the helix angle of cap helical thread 16. This relationship can be seen in FIG. 6. By having ribs 18 slope downwardly opposite the slope of cap thread 16 it is insured that the first portion of the counter-clockwise rotation of cap 11 to loosen it from container 24 will not require fracture of rib 18. This fact is depicted in FIG. 2 wherein it is shown that rib 18 is bent back upon itself as cap 11 begins rotation. No fracture has occurred at this point and only the torque necessary to loosen cap 11 from container 24 is exerted by the user of the package of this invention. The distance which cap 11 can rotate prior to fracture of rib 18 will be determined by the free length "a", as depicted in FIG. 1, of rib 18. It has been found that for packaging of most products that rib 18 preferably has length "a" within the range of from about 1/16 to about ⅜ inch. The longer length "a" is, the more rotation of cap 11 can occur prior to fracture of rib 18. The length of rib 18 will be determined by the extent of cap rotation prior to rib fracture that the packager can tolerate with his particular product.

Figure 4:
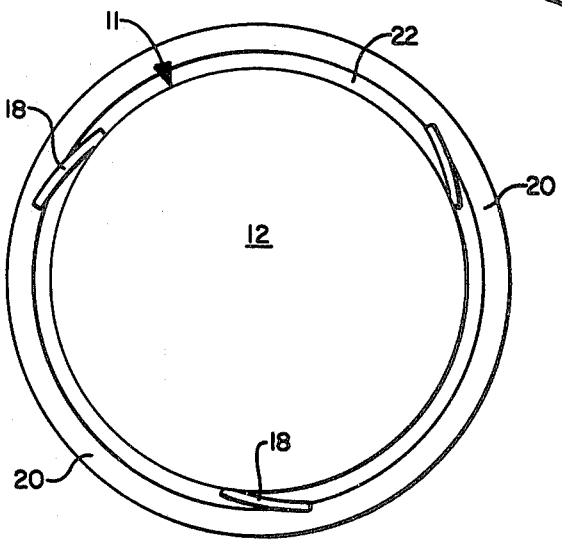
FIG. 4 is a top plan view of the cap shown in FIG. 1.
Figure 5:
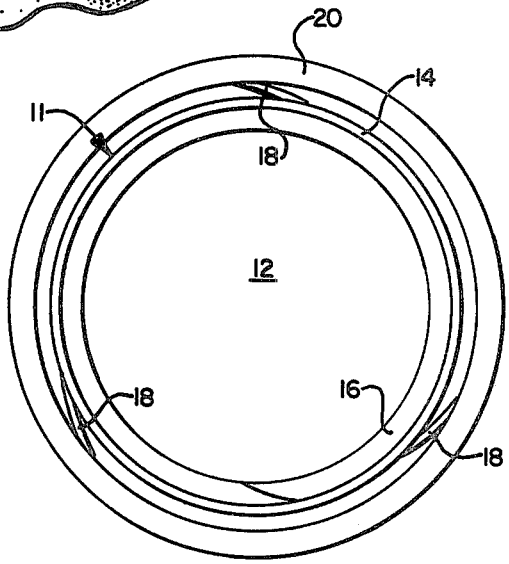
FIG. 5 is a bottom plan view of the cap shown in FIG. 1.
Figure 6:
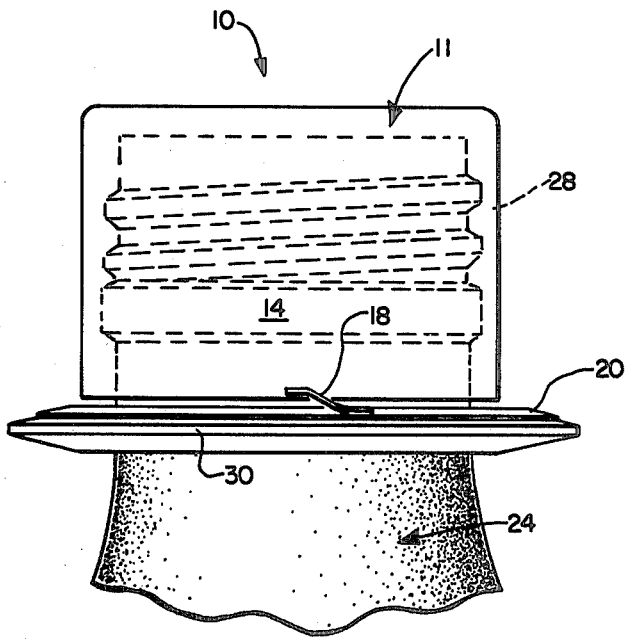
FIG. 6 is a side elevational view of the package shown in FIG. 1 depicting the container and closure threads in phantom line.

Annular cap flange 20, for the embodiment shown in the drawings, has an inside diameter larger than the outside diameter of cap sidewall 14. The outside diameter of annular cap flange 20 is smaller than the outside diameter of container flange 30 to insure that annular cap flange 20 can totally fit onto the upper surface of container flange 30. When utilizing an annular cap flange with an inside diameter larger than the outside diameter of cap sidewall 14 it can be seen that ribs 18 depend downwardly and slightly outwardly as shown in FIGS. 4 and 5. It is understood, of course, that if the inside diameter of annular cap flange 20 is the same or slightly smaller than the outside diameter of cap sidewall 14 that ribs 18 will simply project downwardly and in some instances maybe slightly inwardly. The particular aesthetics that are required by the packager will determine the diameter of annular cap flange and container flange 30.

As mentioned previously, container 24 has a flange 30 upon which annular cap flange 20 contacts and attaches rigidly thereto. This container flange 30 is, of course, positioned so that it will be beneath the lowermost extent of container sidewall 14.

Figure 3:
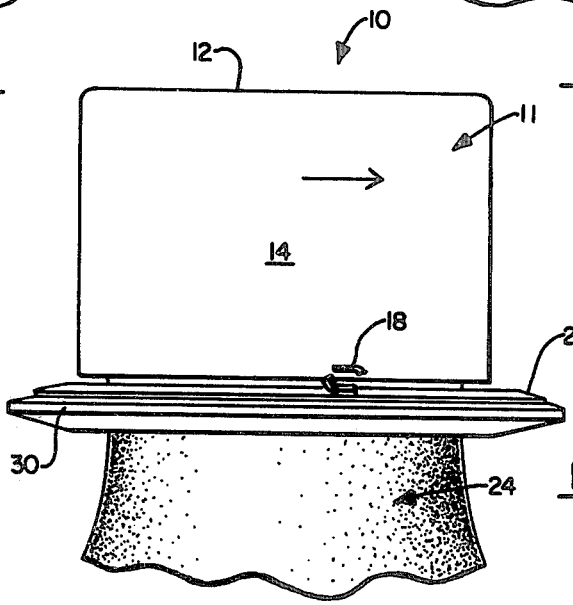
FIG. 3 is a side elevational view of the package shown in FIG. 1 with the closure being rotated so that the connecting ribs are fractured.

In FIGS. 1–3, tamper-proof package 10 is known through various stages of its opening. In FIG. 1 the package is in a closed position with cap 11 securely tightened to container 24. In FIG. 2, loosening of cap 11 has occurred. Note that rib 18 has not fractured but has rather bent back upon itself. As can be appreciated, therefore, torque to fracture rib 18 is not required at this stage, the only torque required being that torque necessary to loosen cap 11 from container 24. In FIG. 3, cap 11 is further unscrewed from container 24 until rib 18 fractures. Since cap 11 has already been loosened from container 24, the only torque required, for all practial purposes, is that torque required to fracture rib 18. Once fracture of rib 18 has occurred, closure 11 is removed from container 24 and any attempt to replace it to hide the fact that cap 11 has been removed from container 24 is made obvious by the fractured ribs 18.

Both the cap and closure of this invention may be made by conventional techniques. Container 24 can be made by any conventional blow molding technique, while cap 11 can be made by any conventional injection molding technique.

What is claimed is:

1. A thermoplastic, tamper-proof cap for fitment to a thermoplastic container having a threaded neck and an outwardly projecting flange beneath the container thread, the cap comprising:

a. a top wall;

b. a downwardly extending sidewall, said sidewall having an inwardly projecting helical thread for cooperation with said container threads; and c. an annular cap flange disposed beneath said cap sidewall and adapted for connection to said container flange, said cap flange being connected to said cap by way of a plurality of elongated connecting ribs, said ribs extending downward from said cap sidewall to said cap flange and having a direction of slope opposite the direction of the helix angle of said cap helical thread.

2. The cap of claim 1 wherein said cap flange has an inside diameter greater than the outside diameter of said cap sidewall.

3. The cap of claim 2 wherein said ribs have a length "a" within the range of from about 1/16 inch to about ⅜ inch.

4. The cap of claim 3 wherein said cap and container are made of polyethylene terethphalate and said cap thread is a right-hand thread and said connecting ribs are sloped downwardly in a counter-clockwise direction.

5. The cap of claim 1 wherein said ribs have a length "a" within the range of from about 1/16 inch to about ⅜ inch.

6. The cap of claim 1 wherein the cap thread is a right-hand thread and said connecting ribs are sloped downwardly in a counter-clockwise direction.

7. The cap of claim 1 wherein said cap and closure are of polyethylene terephthalate.

8. A tamper-proof package comprising:

a. a thermoplastic container having a threaded neck and an outwardly projecting flange beneath the container threads; and b. a thermoplastic cap having:

i. a top wall;

ii. a downwardly extending sidewall, said sidewall having an inwardly projecting helical thread for cooperation with said container thread; and iii. an annular cap flange disposed beneath said cap sidewall and adapted for connection to said container flange, said cap flange being connected to said cap by way of a plurality of elongated connecting ribs, said ribs extending downward from said cap sidewall to said cap flange and having a direction of slope opposite the direction of the helix angle of said cap helical thread.

9. The package of claim 8 wherein said cap flange has an inside diameter greater than the outside diameter of said cap sidewall.

10. The package of claim 9 wherein said ribs have a length "a" within the range of from about 1/16 inch to about ⅜ inch.

11. The package of claim 8 wherein said ribs have a length "a" within the range of from about 1/16 inch to about $\frac{3}{8}$ inch.

12. The package of claim 8 wherein the cap thread is a right-hand thread and said connecting ribs are sloped downwardly in a counter-clockwise direction.

13. The cap of claim 12 wherein said cap and container are made of polyethylene terephthalate and said cap thread is a right-hand thread and said connecting ribs are sloped downwardly in a counter-clockwise direction.

14. The cap of claim 8 wherein said cap and closure are of polyethylene therephthalate.

* * * * *